US009879663B2

(12) United States Patent
Ellis

(10) Patent No.: US 9,879,663 B2
(45) Date of Patent: Jan. 30, 2018

(54) MULTI-PHASE PUMP SYSTEM AND METHOD OF PUMPING A TWO-PHASE FLUID STREAM

(71) Applicant: ADVANCED COOLING TECHNOLOGIES, INC., Lancaster, PA (US)

(72) Inventor: Michael C. Ellis, Marietta, PA (US)

(73) Assignee: Advanced Cooling Technologies, Inc., Lancaster, PA (US)

( * ) Notice: Subject to any disclaimer, the term of this patent is extended or adjusted under 35 U.S.C. 154(b) by 329 days.

(21) Appl. No.: 13/782,595

(22) Filed: Mar. 1, 2013

(65) Prior Publication Data

US 2014/0246095 A1 Sep. 4, 2014

(51) Int. Cl.

| | |
|---|---|
| ***F04B 23/08*** | (2006.01) |
| ***F04F 5/24*** | (2006.01) |
| ***F04F 5/54*** | (2006.01) |
| *E21B 43/36* | (2006.01) |
| *F17D 1/00* | (2006.01) |

(52) U.S. Cl.

CPC ..... *F04B 23/08* (2013.01); *F04F 5/24* (2013.01); *F04F 5/54* (2013.01); *E21B 43/36* (2013.01); *F17D 1/005* (2013.01); *Y10T 137/0318* (2015.04); *Y10T 137/86131* (2015.04)

(58) Field of Classification Search

CPC ..... Y10T 137/86131; Y10T 137/0318; F04B 23/08; F04F 5/54; F04F 5/24; F17D 1/005; E21B 43/36

See application file for complete search history.

(56) References Cited

U.S. PATENT DOCUMENTS 2,179,919 A 11/1939 Carr et al.
2,762,451 A * 9/1956 McNeil ..... B04C 5/103 55/428
3,011,966 A * 12/1961 Jahnentz ..... C07C 7/11 208/187
3,633,377 A 1/1972 Quick
(Continued)

FOREIGN PATENT DOCUMENTS

GB 2186283 * 8/1987

OTHER PUBLICATIONS

"Pressure Regulators vs. Backpressure Regulators" published Jul. 1, 2010 accessed at <https://web.archive.org/web/20100701132854/http://plastomatic.com/bprvspr.html>.*

*Primary Examiner* — Amber R Orlando
*Assistant Examiner* — Stephen Hobson
(74) *Attorney, Agent, or Firm* — McNees Wallace & Nurick LLC

(57) ABSTRACT

A multi-phase pump system and method that directs incoming two-phase flow into a fixed cylinder that contains a vortical flow. The system includes a momentum-driven, vortex phase separator, the phase separator accepting liquid-gas flows at any ratio from all liquid to all gas. The pump system also includes a liquid prime mover; a gas prime mover; and a control system. The vortical flow is driven by injecting the two-phase or another fluid stream tangent or approximately tangent to the curved surface of the cylindrical chamber. Inertial forces generated within the vortical flow drive a buoyancy-driven separation process within the cylindrical chamber. Single-phase prime movers are then used to pump the separated phases to a higher pressure.

14 Claims, 3 Drawing Sheets

(56) References Cited

U.S. PATENT DOCUMENTS 4,147,479 A 4/1979 Morse
4,170,555 A * 10/1979 Vicard ..... B01D 21/0009 210/197
4,213,307 A * 7/1980 Watson ..... F04D 29/063 62/192
4,978,374 A * 12/1990 Janssen ..... B67D 7/0484 141/46
5,050,392 A 9/1991 Messmer et al.
5,256,171 A 10/1993 Payne
5,490,562 A * 2/1996 Arnold ..... B01D 19/0068 166/267
5,570,744 A * 11/1996 Weingarten ..... B01D 19/0057 166/357
5,879,422 A * 3/1999 Brottgårdh ..... B01D 19/0057 55/325
6,142,743 A 11/2000 Charron
6,209,641 B1 * 4/2001 Stevenson ..... E21B 43/124 166/105.5
6,234,030 B1 * 5/2001 Butler ..... E21B 21/01 73/195
6,296,690 B1 10/2001 Charron
6,629,821 B1 10/2003 Yokoto et al.
7,013,978 B2 * 3/2006 Appleford ..... E21B 43/36 166/105.5
7,118,819 B2 10/2006 Grasso
7,569,097 B2 8/2009 Campen et al.
7,708,059 B2 * 5/2010 Shaw ..... E21B 43/128 166/105.5
7,713,335 B2 5/2010 Ringenberger et al.
7,770,651 B2 * 8/2010 Krehbiel ..... B01D 17/02 166/344
7,819,950 B2 * 10/2010 Stinessen ..... E21B 43/36 166/357
7,905,946 B1 * 3/2011 Weislogel ..... B01D 45/06 55/428
7,942,162 B2 * 5/2011 Torres ..... F17D 1/005 137/561 A
8,057,580 B2 * 11/2011 Poorte ..... E21B 43/12 95/254
8,087,293 B2 1/2012 Dou et al.
8,210,506 B1 * 7/2012 Ellis ..... F28C 1/06 165/60
8,393,876 B2 * 3/2013 Sloteman ..... F04D 9/003 417/313
8,899,557 B2 * 12/2014 Cullinane ..... B01D 19/0036 261/76
9,068,338 B2 * 6/2015 Padgett, Jr. ..... F16L 3/01
9,303,658 B2 * 4/2016 Maier ..... F04D 31/00
2001/0011556 A1 * 8/2001 Butler ..... F04D 31/00 137/565.29
2002/0164512 A1 * 11/2002 Grasso ..... H01M 8/04029 429/437
2007/0274842 A1 * 11/2007 Campen ..... F04B 47/06 417/53
2008/0098893 A1 * 5/2008 Ringenberger ..... B67D 7/763 95/261
2010/0187180 A1 * 7/2010 Baten ..... B01D 45/16 210/718
2011/0203460 A1 * 8/2011 Skofteland ..... F04D 25/0686 96/408
2011/0223039 A1 * 9/2011 Fang ..... F04B 23/14 417/54
2012/0308408 A1 * 12/2012 Rosvold ..... F04D 13/086 417/199.1
2014/0158364 A1 * 6/2014 Hopper ..... B01D 17/0217 166/357
2014/0246095 A1 * 9/2014 Ellis ..... F04B 23/08 137/1
2015/0021235 A1 * 1/2015 Eriksen ..... E21B 43/36 208/187
2016/0115775 A1 * 4/2016 Eaton ..... B01D 51/10 95/39
2017/0284182 A1 * 10/2017 Hopper ..... B04C 5/15

* cited by examiner

MULTI-PHASE PUMP SYSTEM AND METHOD OF PUMPING A TWO-PHASE FLUID STREAM

FIELD OF THE INVENTION

The present invention is directed to a multi-phase pump system and method of pumping a two-phase fluid stream. In particular, the invention is directed to a multi-phase pump system and method having a momentum-driven, vortex phase separator.

BACKGROUND OF THE INVENTION

In most two-phase systems, the prime mover is a single-phase device, such as a compressor or pump, as pumping a two-phase mixture presents a challenge due to the compressibility of the vapor/gas phase. Various studies have been presented describing degraded pumping performance with two-phase flow under specific sets of conditions.

Centrifugal pumps can pump gas/vapor under certain conditions. As long as the thermodynamic quality of the vapor or gas (defined as the ratio of vapor or gas mass to total mass) is low, the pump may continue to operate, although with degraded performance. As the gas flow and quality increase, flow regime changes result in a separated flow within the pump and significantly reduced pumping capability.

The interest in developing oil resources in deeper water has resulted in some development of multiphase pumping such as the helico-axial multiphase pump, a form of inline rotary pump, which was introduced in the oil and gas industry in the 1990s. This pump uses a diffuser that breaks up large bubbles, which results in a more homogeneous flow. This type of flow allows the liquid momentum to be increased which in turn drags the gas along. Unfortunately, this limits the pumping capability to low quality two-phase flows.

Centrifugal or rotary devices are used in the power industry to raise the pressure head of condensate flows from the condenser to return to the boiler or nuclear reactor. These pumps require a hydrostatic column to provide enough net positive suction head. In addition, the pumps utilize multiple stages to limit the pressure rise per stage.

Gear pumps such as screw pumps, rotary gear pumps, and peristaltic pumps have been demonstrated to pump two-phase flows but only under a specific set of conditions, which limits their application. Typically, these devices can achieve neither high pumping head nor high quality flow.

Jet pumps or Bernoulli pumps have been used in various industries and can be found in vacuum systems, chemical dispensing, fuel cells, and thermal systems. These devices are driven by a nozzle operating at choked, or sonic, conditions. The high velocity flow exiting this nozzle is directed into a mixing chamber and exchanges kinetic energy with a lower pressure fluid. The mixed flows are then directed through a diverging stage that recovers pressure and results in an outlet pressure that lies between that of the inlet and driving flow. These pumps have been shown to pump vapor/gas but the pumps require significant motive flow rates and exhibit parasitic motive pressure drops. In addition, performance degrades significantly outside a narrow range of operation.

The oil and gas industry has relied upon a two-stage approach for pumping multiphase flows. The flow is first directed to a separator which produces separate single phase flow streams that can utilize standard pumps/compressors to raise the head of each phase. A similar approach was utilized with the Foster-Miller pump developed for the Air Force. This pump utilizes a turbine style separator to separate a refrigerant and directed the liquid to a rotating bowl that utilizes a Pitot pump to raise the liquid pressure and a separate centrifugal blower to raise the vapor pressure. The two separated phases, which are now at a higher pressure, can then be mixed as needed. However, this device requires a high power induction motor to provide the high speed rotation required for the Pitot pump and centrifugal blower. The pressure rise capable of this pump is dependent on a number of factors. For gas/vapor, the motor/blower speed and density of the fluid affects the discharge pressure. For liquid, not only does the motor speed affect the pump pressure but the amount of liquid in the bowl has an impact on pressure rise. Both of these effects are related to the hydrostatic pressure generated within the bowl and available to the Pitot pump.

Current aircraft electronics are cooled using conduction, forced-air cooling, or single phase liquid cooling. Thermal management by conduction alone can only be accomplished for low heat flux components that have access to a sufficiently cool sink, such as aircraft skin or fuel, within a short distance. For most electronics, cooling by conduction alone is not feasible and forced convection is necessary. The most accessible medium for convective cooling is air. However, air cooling is limited to low powers. As the power densities of aircraft electronics increase, air cooling becomes less attractive and liquid cooling is typically used. A liquid cooling system uses a single phase pumped loop with a liquid coolant, such as Polyalphaolephin (PAO) or aircraft fuel. Pumped liquid loops can transfer significantly more waste heat with lower thermal resistances than air cooling. The costs for these improvements are increased mass, power consumption, and system complexity.

Benefits associated with the integration of propulsion, electrical power, and Thermal Management Subsystems (TMS) have been identified. Associated with these benefits, however, are new thermal management challenges related to the collection, transport, and rejection of the waste heat produced by these subsystems. Subsystem integration results in higher power densities. Replacement of mechanical and analog systems with their digital counterparts results in aircraft that produce more waste heat than their predecessors. Higher power densities and compact assembly geometries make air cooling infeasible. Larger waste heat loads result in increased mass and power requirements for liquid pumped loops. As a result, issues with thermal management systems have been identified. New solutions that increase the effectiveness of both the component and aircraft thermal management systems are needed for the next generation of aircraft.

Current spacecraft thermal management involves single-phase pumped loops or passive, two-phase, capillary devices such as Constant Conductance Heat Pipes (CCHP), Capillary Pumped Loops (CPL), and Loop Heat Pipes (LHP). For low power applications, capillary devices are more attractive than single-phase systems due to their passive operation and use of latent heat transport, which allows for isothermal operation and less working fluid mass. Among these devices, CCHPs are the most common among satellite thermal management systems. However, CCHP systems are considerably design specific, which makes them difficult to interchange between applications and intolerant of design changes within an application. In addition, complex CCHP geometries are difficult to ground test. CPLs and LHPs, which share common operating principles, are somewhat more flexible as they are capable of pumping over significant distances using non-wicked transport lines and ground testing is not an issue. CPLs and LHPs have found application in several programs, such as the Hubble Space Telescope and Geoscience Laser Altimetry System. However, they are known to encounter start-up and transient anomalies which can lead to failure. To provide reliable start-up and de-priming recovery, electrical heaters or thermoelectric devices are often employed, which somewhat negates the passive advantage of capillary loops.

Moreover, all capillary devices share two disadvantages. First, they are restricted to relatively low powers of about a kilowatt or less, depending on wick design and available capillary head. This presents a problem considering increasing spacecraft thermal management demands. To meet higher powers, multiple capillary devices are needed. Second, capillary systems entail complicated fabrication processes related to wick performance and working fluid purity. These processes lead to higher fabrication and testing costs.

Single-phase pumped loops have been identified as a more flexible alternative to capillary systems in that they can operate with multiple heat sinks and sources, ground test well, require less analysis and design related to integration, and are capable of transporting considerably higher power. Single-phase systems have found application with the International Space Station, Mars Pathfinder, and Mars Exploration Rovers. However, these systems are actively pumped and, as such, require more power than passive devices such as CCHPs. Furthermore, since thermal energy is transported by sensible heating or cooling of the working fluid, these systems require higher mass flow rates, of approximately an order of magnitude or more, which affect pump size and power consumption, and larger system volume than two-phase systems for equivalent power levels. In addition, single-phase heat transfer is less efficient than condensation and evaporation, resulting in larger heat exchangers for single-phase systems.

SUMMARY OF THE INVENTION

There is broadly contemplated herein, a multi-phase pump system that directs incoming two-phase flow into a fixed cylinder that contains a vortical flow. The vortical flow is driven by injecting the two-phase or another fluid stream tangent or approximately tangent to the curved surface of the cylindrical chamber. Inertial forces generated within the vortical flow drive a buoyancy-driven separation process within the cylindrical chamber. Single-phase prime movers are then used to pump the separated phases to a higher pressure.

This system generally relies on four main components: a momentum-driven, vortex phase separator, a liquid prime mover, a vapor prime mover, and a control system. The phase separator accepts liquid-gas flows at any ratio from all liquid to all gas. These phases are separated and fed to the liquid and vapor prime mover inlets. At the output of these prime movers, each phase is at a higher pressure. The two phases can be remixed or not depending on system application. As a result, two-phase pumping is achieved. The control system regulates system flow rates to maintain the amount of each phase present in the separator within acceptable limits.

The prime movers can be any device capable of increasing the pressure of a fluid. Possibilities include centrifugal liquid pumps, positive displacement pumps, gas blowers, and gas compressors. Selection of the prime mover depends primarily on system application. The ability to provide two-phase pumping using proven single-phase devices is a significant system benefit and feature made possible by the phase separator.

An embodiment is directed to a multi-phase pump system for directing a two-phase flow. The system includes a momentum-driven, vortex phase separator, the phase separator accepting liquid-gas flows at any quality from all liquid to all gas. The pump system also includes a liquid prime mover; a gas prime mover; and a control system.

The momentum-driven, vortex phase separator can be a fixed cylinder that contains a vortical flow. The vortical flow may be driven by injecting the two-phase flow tangent or approximately tangent to a curved surface of a cylindrical chamber of the fixed cylinder. Alternatively, the vortical flow may be facilitated by injecting a fluid stream other than the two-phase flow tangent or approximately tangent to the curved surface of the cylindrical chamber of the fixed cylinder.

The flow may be centripetally accelerated to generate centrifugal forces and develop a pressure gradient to drive a buoyancy-driven separation process within a cylindrical chamber of the fixed cylinder.

The gas flow rate of the gas separated by the phase separator may be controlled by a back-pressure regulator located between a gas outlet of the phase separator and the gas prime mover. The liquid flow rate of the liquid separated by the phase separator may be controlled by a back-pressure regulator located after the liquid prime mover. The subcooling required for the liquid prime mover may be provided by an eductor, by use of hydrostatic pressure, or by use of a heat exchanger that interfaces with cooler fluid flowing in the system.

The phase separator may include a cylindrical separation chamber, a tangential inlet nozzle, a baffle plate, and liquid and gas outlets. The fixed baffle plate prevents the gas phase from interacting with the liquid outlet, whereby the phase separator can manage a significant variation in the amount of the liquid phase, allowing the phase separator to operate as a buffer volume between system components.

An embodiment is also directed to a method of pumping a two-phase fluid stream through a multi-phase pump system, the method comprising: directing incoming two-phase fluid stream into a fixed cylinder chamber that contains a vortical flow; injecting the two-phase fluid stream tangent or approximately tangent to a curved surface of the cylindrical chamber; regulating the two-phase fluid stream; generating inertial forces within the vortical flow to drive a buoyancy-driven separation process within the cylindrical chamber, separating the two-phase fluid stream into a liquid stream and a gas stream; accumulating the liquid stream in the fixed cylinder chamber; pumping the gas stream to a higher pressure than the two-phase fluid stream; and pumping the liquid stream to a higher pressure than the two-phase fluid stream.

The method may also include accelerating a portion of the liquid stream; mixing the accelerated portion of the liquid stream with a portion of the liquid stream which exits the cylindrical chamber; directing the mixed liquid stream through a diffuser section, expanding the flow area and converting dynamic pressure to static pressure, increasing the pressure of the mixed liquid stream.

A portion of the liquid stream may be directed to recirculating flow loops that do not alter the liquid content of an output stream of the multi-phase pump system, with a portion of this recirculating liquid stream directed to drive a phase separator, an eductor, or both. A back-pressure regulator may also be provided to control the pressure in the recirculating flow loops.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
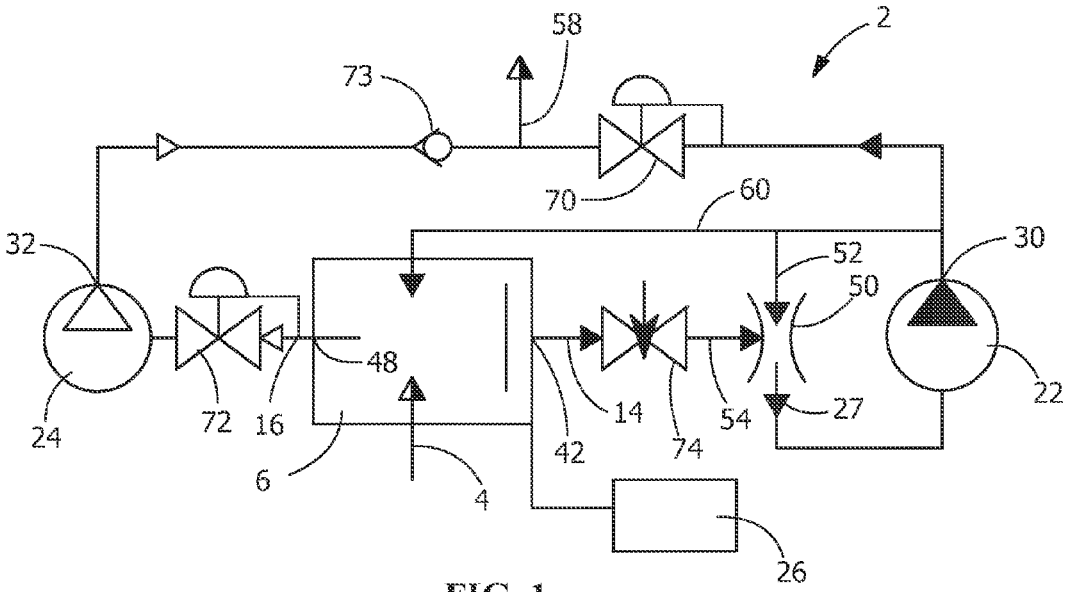
FIG. 1 is a schematic view illustrating an embodiment of multi-phase pump system with a two-phase outlet.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 2:
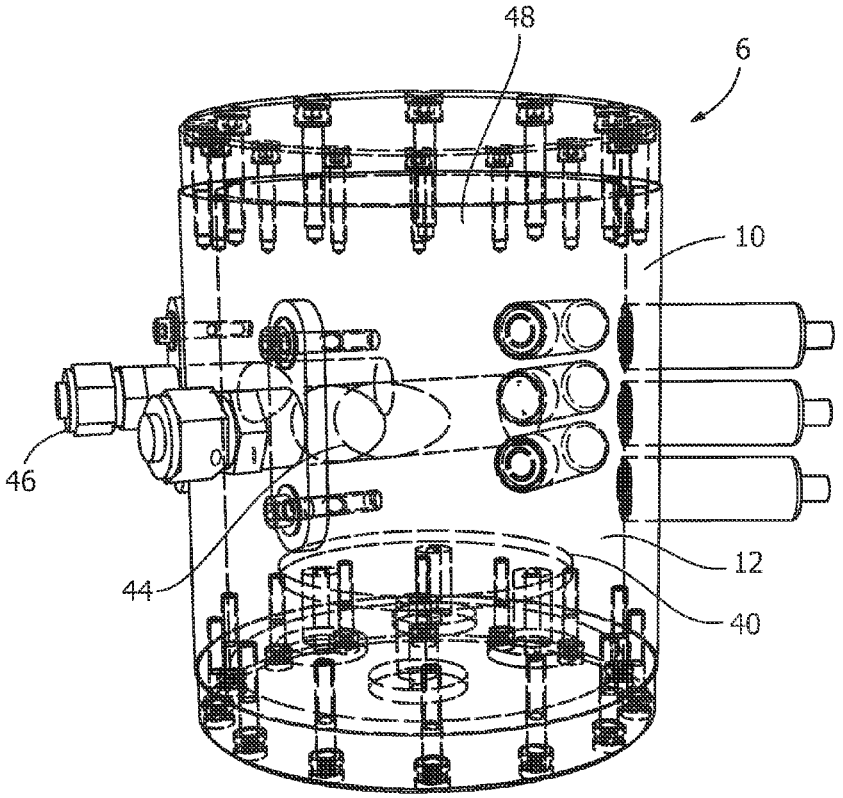
FIG. 2 is a perspective view of an embodiment of a phase separator which can be used in the multi-phase pump system of FIG. 1.
Figure 3:
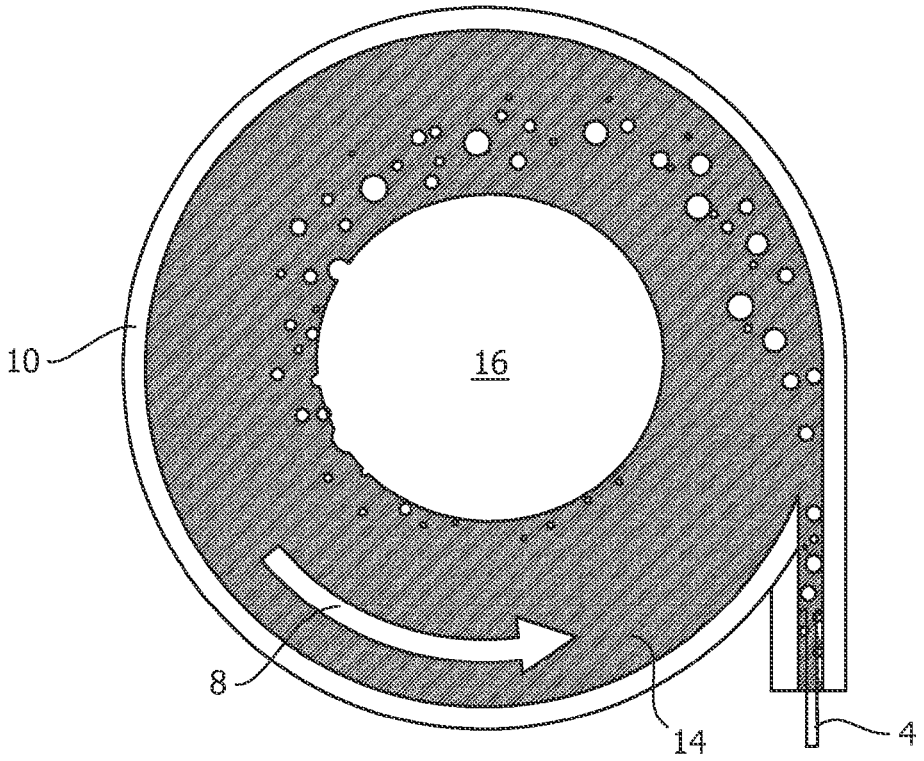
FIG. 3 is a cross-sectional view of the phase separator of FIG. 2 taken along the radius of the cylindrical chamber, illustrating the flow of the liquid and gas phases.

Referring to FIGS. 1 and 2, a multi-phase pump system 2 is shown that directs incoming two-phase fluid stream 4 into a fixed cylinder or phase separator 6 that contains a vortical flow 8 (FIG. 3). In the embodiment shown, the vortical flow 8 is driven or produced by injecting the two-phase fluid stream 4, or another fluid stream, tangent or approximately tangent to a curved surface 10 of a cylindrical chamber 12. Inertial forces generated within the vortical flow 8 drive a buoyancy-driven separation process within the cylindrical chamber 12, separating the two-phase fluid stream 4 into a liquid stream/flow 14 and a gas/vapor stream/flow 16. Single-phase prime movers are then used to pump the separated phases to a higher pressure.

In the embodiment shown, the multi-phase pump system 2 has a momentum-driven, vortex phase separator 6, a liquid prime mover 22, a vapor prime mover 24, and a control system. The control system in this embodiment consists of a throttling valve 74, an eductor 50, a liquid back-pressure regulator 70, a gas back-pressure regulator 72, and a check valve 73. The phase separator 6 accepts liquid-gas flows at any quality from all liquid to all gas. These phases are separated and fed to the liquid and vapor prime mover inlets. At the output 30, 32 of these prime movers 22, 24, each phase is at a higher pressure. The two phases can be remixed or not depending on system applications. As a result, two-phase pumping is achieved. The control system regulates system flow rates to maintain the amount of each phase present in the separator 6 within acceptable limits.

The prime movers 22, 24 can be any device capable of increasing the pressure of a single-phase fluid 14, 16, such as, but not limited to, centrifugal liquid pumps, positive displacement pumps, gas blowers, and gas compressors. Selection of the prime mover 22, 24 depends primarily on system application.

The ability to provide two-phase pumping using proven single-phase devices is achieved by the phase separator 6. While there are several types of phase separators, a separator having one or more of the following characteristics is beneficial: high throughput; compact size; gravity-independent, acceleration-tolerant operation; and/or the ability to accumulate fluid. In some embodiments and applications, separation forces must be larger than and dominate other forces which the system may experience. This allows the two-phase pump to be used across various applications, including but not limited to terrestrial, aerospace, and micro-gravity. In order to minimize pressure variations at the pump outlet, it may be beneficial for the two-phase pump to regulate inlet conditions at the prime movers despite fluctuation in fluid quality and other transients, which may be rapid. Therefore a separator that can accumulate fluids to provide a volume buffer between the two-phase flow inlet and the single-phase prime mover inlets is beneficial to the two-phase pump system. In so doing, the volume buffer provides the control system time to analyze and respond to system transients.

Referring to FIG. 2, in the embodiment shown, momentum of the phase separator 6 is provided by a driving flow injected tangentially or essentially tangentially along the curved surface or wall 10 of the cylindrical separation chamber 12. Depending on rotational speed and pressure drop requirements, this driving flow may be the multi-phase flow requiring separation. The driving flow is centripetally accelerated by the cylindrical wall of the chamber and produces a forced vortex within the separation chamber. The liquid within the separation chamber experiences centrifugal force as a result of this acceleration and develops the pressure gradient necessary for buoyancy driven separation.

Figure 4:
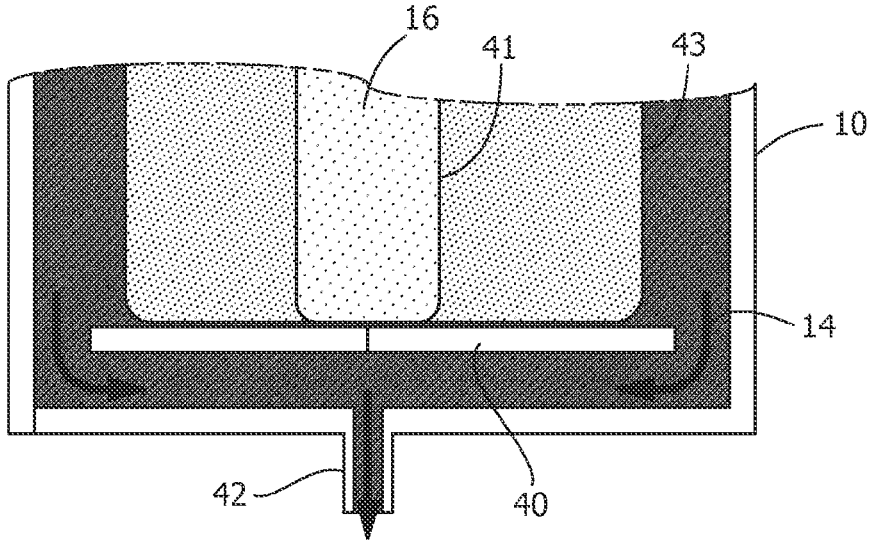
FIG. 4 is a partial cross-sectional view of the phase separator of FIG. 2 taken along the central axis of the cylindrical chamber, illustrating an embodiment of a baffle plate and liquid outlet and the variance in the buffer volume.

In the axial direction, the gas/vapor phase or stream 16 and liquid phase or stream 14 are separated using a fixed baffle plate 40, as best shown in FIG. 4. This prevents the gas/vapor phase 16 from interacting with the liquid outlet 42. Proper sizing of the baffle plate allows stable operation of the phase separator 6 with different gas/vapor to liquid volume ratios or other different fluid quality measures. As a result, the phase separator 6 can manage a significant variation in the amount of each fluid phase; thereby allowing the phase separator to operate as a buffer volume between system components. FIG. 4 shows a minimum interface 41 and a maximum interface 43. The interfaces are provided to illustrate the acceptable variance in the buffer volume. At an given moment, only one interface is provided which can range from the minimum interface to the maximum interface. As an example, fluid quality changes resulting from thermal transients at the evaporator of a thermal management system can be decoupled from the system prime movers 22, 24 by placing the phase separator 6 between the evaporator and the prime movers.

Referring again to FIG. 2, the phase separator 6 includes the cylindrical separation chamber 12, a tangential inlet nozzle 44, optional two-phase inlets 46, the baffle plate 40, and the liquid and gas outlets 42 (FIG. 4), 48 (FIG. 2). The phase separator 6 shown in this embodiment has one single phase inlet nozzle 44 to drive the vortex and two two-phase inlet ports, although other configurations can be used without departing from the scope of the invention, including, but not limited to, having multiple driving nozzles or inlet ports. In addition, inlet ports do not need to be tangential to the flow, although this orientation is preferred for maximum efficiency in many applications.

The two-phase pump system 2 accepts two-phase flow 4 of any quality and outputs this flow at an equivalent mass flow rate but significantly higher pressure. As best shown in FIG. 4, two-phase flow first enters the phase separator 6 and is then separated. The liquid phase or stream 14, at saturation, is directed through the liquid outlet 42 and then to the jet pump or eductor 50 (as represented in FIG. 1).

Figure 5:
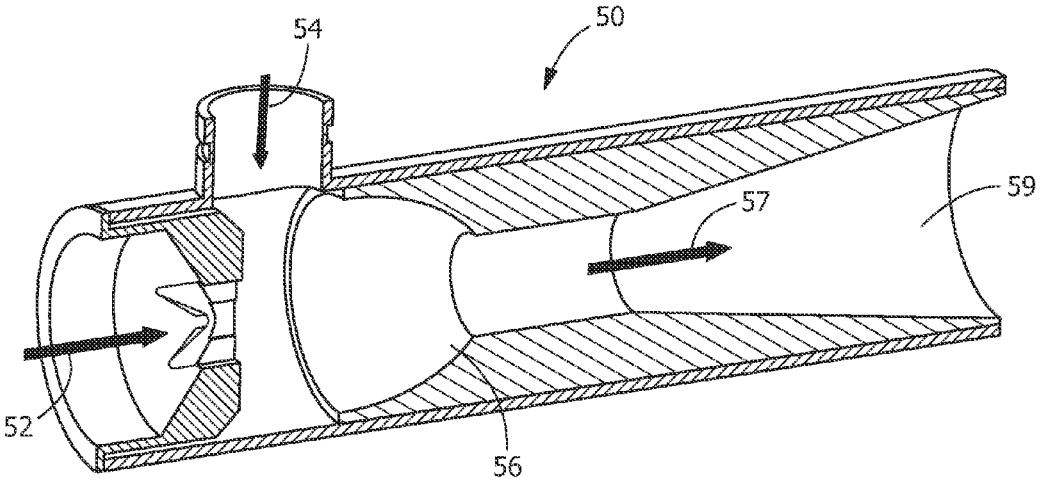
FIG. 5 is a section view of an embodiment of an eductor which can be used in the multi-phase pump system of FIG. 1.

The eductor 50, as shown in FIG. 5, is driven by a recirculating flow from the liquid pump. The eductor 50 operates by accelerating this driving, subcooled liquid flow 52, which then transfers kinetic energy to the saturated liquid flow 54 directed from the phase separator 6. This mixed flow, which may possess a low quality, is then directed through the diffuser section 59 of the eductor 50. In this section, the flow area expands and converts dynamic pressure to static pressure. As a result, flow 57 exiting the eductor 50 is at a higher pressure. Proper eductor selection produces an exit flow that is in a subcooled liquid state sufficient to meet the net positive suction head requirements of the single-phase pump. Alternatively, other means of subcooling may be used in place of the eductor, including, but not limited to, hydrostatic pressure and heat transfer with a cooler fluid. Liquid exiting the eductor enters the pump, where pressure is increased and directed to the two-phase outlet.

Referring again to FIG. 1, simultaneously, gas/vapor flow 16 exits the phase separator 6 at the gas outlet 48 and is directed to the vapor/gas prime mover 24 or compressor, where gas/vapor is compressed to a higher pressure and temperature. The liquid phase 14 and the gas/vapor phase 16 are then remixed prior to exiting the system 2 at the two phase outlet, as represented at 58.

In addition to the liquid flow being directed to the two-phase outlet from the liquid prime mover 22, a portion of the liquid flow 60 is directed to drive the phase separator 6 and eductor 50. Both of these are recirculating flow loops that do not alter the liquid content of the output stream. The amount of return flow directed to each of these recirculating loops depends primarily upon the pressure drops of the nozzles driven by these flows. The phase separator 6 and eductor 50 nozzles are both liquid nozzles with constant outlet area and, therefore, operate with a fixed flow rate for a given pressure drop.

The inlet pressure of both nozzles is controlled by the back-pressure regulator 70 located on the liquid pump outlet line. The vapor/gas outlet pressure of the phase separator nozzle is controlled by the back-pressure regulator 72 on the phase vapor/gas separator outlet 48, which is also proximate to the inlet of the compressor or prime mover 24. As a result, the pressure drop across, and therefore flow rate through, these nozzles can be accurately set. In addition to this back-pressure regulator, the suction pressure of the eductor nozzle also depends on the position of the metering valve 74 located between the phase separator 6 and eductor 50. The position of this valve 74 can be set to provide a constant flow rate to the recirculating loops that drive the phase separator 6 and eductor 50 nozzles.

The phase separator driving nozzle provides sufficient momentum to produce a forced vortex within the device, which provides phase separation. By separating phases, this system 2 allows for the use of proven, single-phase components capable of achieving high output pressures. In addition, the ability of the separation chamber to accumulate fluid provides a buffer between pump performance and inlet quality changes. As a result, changes in inlet quality do not affect the performance of the pumping stage.

Isolating the system 2 from changes in inlet quality is beneficial for several reasons. Changes in quality affect the mass flow rate of each phase that enters the phase separator from the two-phase nozzle. For stable operation, changes in inlet quality cannot affect the saturation pressure inside the phase separator, as variation in this pressure will result in phase change within the phase separator. If allowed to occur, this phase change could happen anywhere in the separation chamber, causing liquid droplets to condense in the gas/vapor space and/or gas/vapor bubbles to be produced in the liquid outlet. Either would result in separation failure and possible damage to the pump or compressor. In addition, variations in inlet pressure would result in variations in the output pressure and flow rate of these components and unstable two-phase pump performance.

To maintain the desired saturation pressure in the phase separator, the control system monitors and regulates the outlet mass flow rate to match the inlet mass flow rate. A mismatch will result in the accumulation or discharge of fluid from the phase separator volume. While the phase separator is designed to manage some degree of mismatch between the inlet and outlet mass flow rate, continued operation in this mode is not possible. For that reason, the phase separator control system is designed to regulate the flow of gas/vapor and liquid through their respective outlet ports. Gas/vapor flow is managed by a back-pressure regulator while a metering valve adjusts pressure drop between the phase separator and eductor, which effectively controls liquid outlet flow rate.

The back-pressure regulator does not allow flow until the phase separator has reached a specific pressure, which is set to the desired saturation pressure for the low side of the two-phase pump system 2. Flow leaving this valve feeds the compressor. As gas/vapor flow into the phase separator increases, this valve opens to prevent an increase in pressure above the set point. In cases when the phase separator has been operating with a saturation pressure below the set point, the back-pressure regulator will allow the phase separator to accumulate gas/vapor until the set point is reached. This feature allows the phase separator to recover from a decrease in quality. Since the reduction in quality will initially result in a decrease in the phase separator pressure, the back-pressure regulator will allow gas/vapor to accumulate until the set point is again reached.

To maintain inventory balance within the phase separator, liquid flow must also be adjusted to meet changes in quality. Liquid flow is controlled by the eductor metering valve. As the mass flow rate pulled through the eductor suction port is proportional to the pressure at the suction port, by increasing the pressure drop between the phase separator and eductor using the metering valve, eductor suction flow rate is controlled to stabilize phase separator liquid volume. The metering valve is adjusted based on phase separator inventory, which could be monitored using an acoustic gauge oriented to read across the phase separator radius. Mounted in this direction, the acoustic sensor would read the liquid film thickness on the wall of the separator. This film thickness can be correlated to phase separator volume, which must be maintained between specific limits for proper separation performance.

Two-phase pumped loops have been shown to have significantly less mass than single-phase pumped loops when high thermal management capacity is required. This results from the ability of the two-phase system 2 to use the latent heat of the working fluid to transport thermal energy. In addition, two-phase systems are designed to transfer heat at saturation conditions, which results in a constant working fluid temperature and larger available temperature potential to drive the heat transfer process. Two-phase heat transfer at saturation conditions is also much more efficient than single-phase heat transfer, which results in significantly higher heat transfer coefficients for the former. All of these advantages result in less massive and more compact thermal management systems. The cost of this improvement is the additional complexity that results from managing the two-phase working fluid. The purpose of the concept disclosed here is to provide a simplified approach for two-phase thermal management.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A multi-phase pump system for directing a two-phase flow, the multi-phase pump system comprising:

a gravity-independent momentum-driven, vortex phase separator, the phase separator having a two-phase flow inlet accepting incoming liquid-gas flows at any quality from all liquid to all gas, the separator having the liquid-gas flows being centripetally accelerated to produce a momentum driven vortical flow to drive a buoyancy driven separation process which separates a single phase vortical liquid flow from a single phase vortical gas flow, the separator having a liquid outlet for removing the single phase vortical liquid flow from the separator and a gas outlet for removing the single phase vortical gas flow from the separator;

a liquid prime mover which receives liquid from the liquid outlet;

a gas prime mover which receives gas from the gas outlet and which is independent from the liquid prime mover;

a volume buffer provided between the two-phase flow inlet and a baffle spaced from the liquid outlet and the gas outlet;

a control system;

the gas prime mover and the liquid prime mover operate independently, the gas prime mover interacts with gas flow separated from the incoming liquid-gas flows to drive the gas flow at independent rates and qualities from the incoming liquid-gas flows, the liquid prime mover interacts with liquid flow separated from the incoming liquid-gas flows to drive the liquid flow at independent rates and qualities from the incoming liquid-gas flows and independent from the gas flow;

wherein the momentum driven vortical flow is facilitated by injecting a fluid stream other than the two-phase flow tangent or approximately tangent to the curved surface of the cylindrical chamber of the fixed cylinder.

2. The multi-phase pump system as recited in claim 1, wherein the momentum-driven, vortex phase separator is a fixed cylinder that contains the momentum driven vortical flow.

3. The multi-phase pump system as recited in claim 2, wherein the vortical flow is driven by injecting the two-phase flow tangent or approximately tangent to the curved surface of a cylindrical chamber of the fixed cylinder.

4. The multi-phase pump system as recited in claim 2, wherein an injected flow is centripetally accelerated to generate centrifugal forces and develop a pressure gradient to drive a buoyancy-driven separation process within a cylindrical chamber of the fixed cylinder.

5. The multi-phase pump system as recited in claim 1, wherein the all gas is a saturated vapor of a liquid.

6. The multi-phase pump system as recited in claim 1, wherein the liquid prime mover is a pump.

7. The multi-phase pump system as recited in claim 1, wherein the gas prime mover is a compressor.

8. The multi-phase pump system as recited in claim 1, wherein a gas flow rate of gas separated by the momentum-driven, vortex phase separator is controlled by a back-pressure regulator located between a gas outlet of the momentum-driven, vortex phase separator and the gas prime mover.

9. The multi-phase pump system as recited in claim 1, wherein a liquid flow rate of a liquid separated by the momentum-driven, vortex phase separator is controlled by a back-pressure regulator located after the liquid prime mover.

10. The multi-phase pump system as recited in claim 1, wherein subcooling required for the liquid prime mover is provided by an eductor.

11. The multi-phase pump system as recited in claim 1, wherein subcooling required for the liquid prime mover is provided using a heat exchanger that cools the liquid.

12. The multi-phase pump system as recited in claim 1, wherein the momentum-driven, vortex phase separator includes a cylindrical separation chamber, a tangential inlet nozzle, a baffle plate, and liquid and gas outlets.

13. The multi-phase pump system as recited in claim 12, wherein the baffle plate prevents a gas phase from interacting with the liquid outlet, whereby the momentum-driven, vortex phase separator can accommodate a significant variation in the amount of a liquid phase.

14. A multi-phase pump system for directing a two-phase flow, the multi-phase pump system comprising:

a gravity-independent momentum-driven, vortex phase separator, the phase separator having a two-phase flow inlet accepting incoming liquid-gas flows at any quality from all liquid to all gas, the separator having the liquid-gas flows being centripetally accelerated to produce a momentum driven vortical flow to drive a buoyancy driven separation process which separates a single phase vortical liquid flow from a single phase vortical gas flow, the separator having a liquid outlet for removing the single phase vortical liquid flow from the separator and a gas outlet for removing the single phase vortical gas flow from the separator;

a liquid prime mover which receives liquid from the liquid outlet;

a gas prime mover which receives gas from the gas outlet and which is independent from the liquid prime mover;

a volume buffer provided between the two-phase flow inlet and a baffle spaced from the liquid outlet and the gas outlet;

a control system;

the gas prime mover and the liquid prime mover operate independently, the gas prime mover interacts with gas flow separated from the incoming liquid-gas flows to drive the gas flow at independent rates and qualities from the incoming liquid-gas flows, the liquid prime mover interacts with liquid flow separated from the incoming liquid-gas flows to drive the liquid flow at independent rates and qualities from the incoming liquid-gas flows and independent from the gas flow;

wherein subcooling required for the liquid prime mover is provided by an eductor.

* * * * *